US005523830A

United States Patent [19]

Tamura et al.

[11] Patent Number: 5,523,830

[45] Date of Patent: Jun. 4, 1996

[54] OIL REMOVING MEANS FOR TRANSFER MATERIAL SUPPORT MEMBER

[75] Inventors: Satoshi Tamura, Yokohama; Takashi Hasegawa, Ageo; Takahiro Kubo, Tokyo, all of Japan

[73] Assignee: Canon Kabushiki Kaisha, Tokyo, Japan

[21] Appl. No.: 435,805

[22] Filed: May 5, 1995

[30] Foreign Application Priority Data

May 9, 1994 [JP] Japan ..... 6-094812

[51] Int. Cl.[6] ..... G03G 15/14

[52] U.S. Cl. ..... 355/271; 355/296; 355/313

[58] Field of Search ..... 355/271, 296, 355/313, 326 R, 327

[56] References Cited

U.S. PATENT DOCUMENTS

| | | | |
|---|---|---|---|
| 4,541,707 | 9/1985 | Yoshinaga . | |
| 5,132,739 | 7/1992 | Mauer et al. | 355/284 |
| 5,386,278 | 1/1995 | Maeyama et al. | 355/271 |
| 5,406,364 | 4/1995 | Maeyama et al. | 355/296 |

OTHER PUBLICATIONS

"Patent Abstracts of Japan", vol. 18, No. 689 (P1850), JP 06–274082, Sep. 30, 1994.

*Primary Examiner*—R. L. Moses

*Attorney, Agent, or Firm*—Fitzpatrick, Cella, Harper & Scinto

[57] ABSTRACT

An image forming apparatus comprising an image bearing member, a transfer material support member, fixing means and oil removing means for removing the oil deposited to the transfer material support member.

The image forming apparatus selects either a first mode in which, after the fixation of the image by the fixing means on a first face of the transfer material, the transfer material bearing the fixed image on the first face is automatically supported on the transfer material support member to transfer an image of the image bearing member to a second face different from the first face of the transfer material, or a second mode in which, after the fixation of the image by the fixing means on a first face of a manually inserted transfer material, the transfer material is discharged from the apparatus without image formation on a second face different from the first face of the transfer material. In case of selection of the first mode, the oil removing means do not effect the oil removal after the transfer of the image of the image bearing member to the first face of the transfer material but effects the oil removal after the transfer of the image of the image bearing member to the second face of the transfer material, while, in case of selection of the second mode, the oil removing means effects the oil removal after the transfer of the image of the image bearing member to the transfer material regardless whether the manually inserted transfer material has passed the fixing means.

13 Claims, 3 Drawing Sheets

OIL REMOVING MEANS FOR TRANSFER MATERIAL SUPPORT MEMBER

BACKGROUND OF THE INVENTION

1. Field of the Invention

The present invention relates to an image forming apparatus in which an unfixed image is formed by transferring an image from an image bearing member to a transfer material supported by a transfer material support member and an image is obtained by fixing said unfixed image to the transfer material by fixing means.

2. Related Background Art

There is already known an image forming apparatus in which an unfixed toner image is formed by transferring a toner image, formed on a photosensitive member, to a transfer material supported by a transfer material support member such as a transfer drum or a transfer belt, and said unfixed toner image is fixed, by heat and pressure, onto the transfer material by a pair of fixing rollers.

The fixing rollers of such image forming apparatus are generally subjected to oil application on the surface, in order to extend the service life of the fixing rollers themselves and to prevent offsetting of the fixed toner to the rollers.

Consequently, the oil is inevitably deposited, though in a small amount, onto the transfer material which has passed the fixing position and on which the unfixed toner image has been fixed. The oil deposited on a part of the transfer material, not bearing the toner image thereon, is absorbed in the transfer material, but that deposited on the toner image cannot be absorbed. Consequently, in case of two-side (both-face) image formation by supporting a transfer material, bearing a fixed toner image on a first face, on the transfer material support member and forming an image on the second face of said transfer material, the oil deposited on said transfer material is transferred, through the transfer material support member, to the photosensitive member and hinders the image formation for the next transfer material.

More specifically, the toner is deposited in an area of the photosensitive member that should remain free of toner, by the adhesive force of the oil deposited onto the photosensitive member, thus forming fog. Also in an area which should appear as solid black, there may be formed a paler image by the insufficient toner transfer from the photosensitive member to the transfer material, again due to the adhesive force of the oil.

SUMMARY OF THE INVENTION

An object of the present invention is to prevent deposition of oil, coated on fixing means, onto the image bearing member through the transfer material and the transfer material support member.

Another object of the present invention is to extend the service life of the transfer material support member and that of the oil removing means for removing the oil deposited on said transfer material support member.

Still other objects of the present invention, and the features thereof, will become fully apparent from the following detailed description which is to be taken in conjunction with the attached drawings.

DETAILED DESCRIPTION OF THE PREFERRED EMBODIMENTS

1st Embodiment

Figure 1:
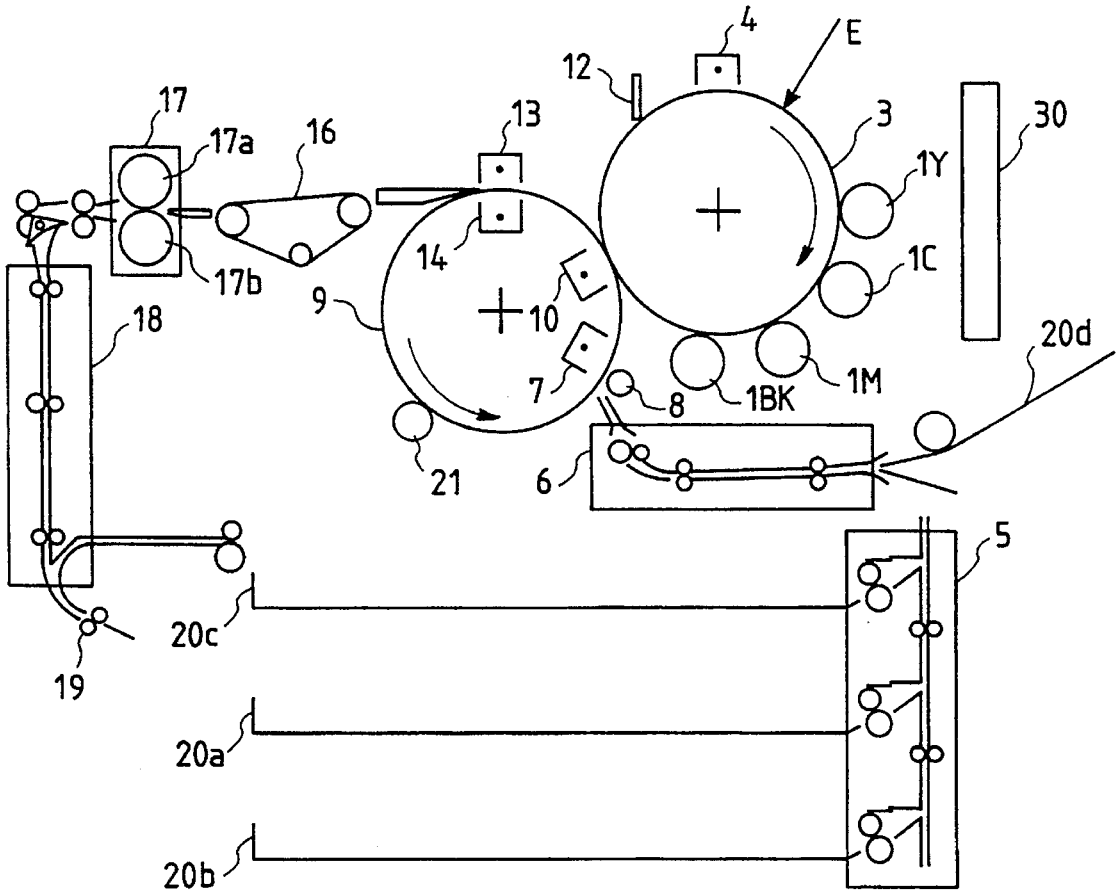
FIG. 1 is a schematic view of a color image forming apparatus constituting a first embodiment of the present invention.

FIG. 1 schematically shows a color image forming apparatus in which the present invention is applicable. The structure and the function of said color image forming apparatus will be explained in the following.

An electrophotographic photosensitive drum 3, constituting an image bearing member, is rotated in a direction indicated by an arrow, and is uniformly charged by a charger 4. It is then subjected to imagewise exposure by a laser beam E modulated by yellow image signals of an original (not shown), whereby an electrostatic latent image formed on the photosensitive drum 3. Adjacent to the photosensitive drum 3, there are provided a yellow (Y) developing unit 1Y, a magenta (M) developing unit 1M, a cyan (C) developing unit 1C, and a black (BK) developing unit 1BK, which receive corresponding developers from developer (toner) supply units of respective colors (not shown).

The latent image formed on the photosensitive drum 3 is subjected to image development by the developing unit 1Y, whereby a visible image (toner image) is formed on the photosensitive drum 3. On the other hand, a recording material, such as a transfer sheet, supplied from a sheet cassette **20*a* or 20*b* through a vertical sheet feeding path 5 and a horizontal sheet feed path 6, or supplied from a manual feed tray 20*d* through the horizontal sheet feed path 6, is electrostatically attracted by a transfer drum 9 by the function of an attraction charger 7 constituting attraction charging means and a contacting roller 8, and is wound on said transfer drum 9**.

The transfer drum 9 is provided, on the surface thereof, with a transfer material support member or a transfer sheet (not shown), and is rotated in a direction indicated by an arrow, in synchronization with the photosensitive drum 3. The toner image developed by the yellow developing unit 1Y is transferred onto the recording material, in a transfer unit by a transfer charger 10 constituting the transfer charging means. The transfer drum 9 continues rotation in preparation for the toner transfer of a next color (magenta in this case). The photosensitive drum 3, having completed the image transfer, is cleaned by a cleaner 12, then charged again by the charger 4 and is subjected to exposure in the same manner as explained above, according to magenta image signals. Image formation is thus repeated for magenta, cyan and black color, and the toner images of four colors are transferred. After the superposed transfer of the toner images of four colors, said toner images on the recording material are subjected to charge elimination by the chargers 13, 14, and the recording material is separated and supplied by a conveyor belt 16 to a fixing unit 17, whereupon a full color printing cycle is completed and a full color printed image is obtained.

In the image formation on the first face of the recording material with the feeding thereof from the sheet feed cassette 20*a* or 20*b*, an oil removing roller 21 does not effect cleaning of the transfer sheet.

A controller 30, provided with a CPU, a ROM, a RAM etc., effects switching control of the image forming sequence according to a flow chart to be explained later, and also effects control of the ordinary image forming sequence.

The fixing unit 17 is provided with a pair of rollers 17*a*, 17*b*, and oil is coated on the roller 17*a* which comes into contact with a face, bearing the unfixed toner image, of the recording material.

On the other hand, in case of automatic two-side image forming operation in which images are automatically formed on both faces of the recording material by a single actuation of a copy button provided on the apparatus, the recording material after the image formation on the first face is supplied to a vertical path 18. After passing said vertical path 18, the recording material is inverted by inversion rollers 19 and supplied to an intermediate tray 20*c*. The recording material temporarily stored in said intermediate tray 20*c* is fed again to the transfer drum 9, and is subjected to image formation on the second face, through an image forming process similar to that for the first face.

In these operations, the oil deposited on the recording material in passing the fixing unit 17 in the sequence for the first face becomes deposited on the transfer sheet in the sequence for the second face. Said oil, if transferred from the transfer sheet to the photosensitive drum 3, undesirably affects the image formation. For this reason, the oil deposited on the transfer sheet has to be removed.

Therefore, in the sequence for the second face after the image transfer of the fourth color and the separation of the recording material from the transfer drum 9, said transfer drum without the recording material thereon is separated from the photosensitive drum 3 and is rotated by a full turn. During said rotation, the oil removing roller 21 is brought into contact with the transfer sheet and removes the oil therefrom. In the sequence for the first face, the oil removing roller 21 is not activated since the oil is not deposited onto the transfer sheet.

As explained in the foregoing, in case of image formation on the recording material fed from the sheet feed cassette 20*a* or 20*b*, the apparatus can discriminate whether the recording material supplied to the transfer drum 9 has already passed the fixing unit 17, so that the oil removing roller 21 is not activated after the image formation on the first face of the recording material but activated after the image formation on the second face, in order to extend the service life of the oil removing roller 12 and the transfer sheet coming into sliding contact with said oil removing roller 21.

On the other hand, in case of feeding the recording material from a manual feed tray 20*d* to the transfer drum 9, it is necessary to set either the image formation on the first face of the recording material which has not passed the fixing unit 17, or that on the second face of the recording material which has already passed the fixing unit 17 and bears a fixed toner image on the first face, by actuation, by the operator, of a button on the operation panel provided on the apparatus or of a sensor for detecting the image formation state of the supplied recording material. However, because of a setting error of the operator or an erroneous judgment of the sensor, the apparatus may erroneously effects the operation of image formation on the first face of the recording material which has not passed the fixing unit 17, although the recording material in face has already passed the fixed unit 17 and already bears the fixed toner image on the first face.

Consequently, in the present embodiment, even in the presence of a setting error of the operator or an erroneous judgment of the sensor and regardless whether the recording material supplied from the manual feed tray 20*d* to the transfer drum 9 has already passed the fixing unit 17 and has therefore been subjected to oil deposition, the oil removing roller 21 is always activated after the image formation to clean the transfer sheet, thereby preventing transfer of the oil, coated in the fixing unit 17, to the photosensitive drum 3.

In the manual insert operation, a setting of employing for example different fixing speeds in the fixing unit 17 for the image formation on the first face of the recording material and for that on the second face does not affect the subsequent image formation, even in the presence of a setting error of the operator or an erroneous judgment of the sensor. Consequently the process condition such as the fixing speed of the fixing unit 17 is set, in case of the manual feeding mode, according to the setting by the operator or the judgment by the sensor, whether the image formation is to be conducted on the first face of the recording material or on the second face of the recording material which already bears the fixed toner image on the first face.

In the following there will be explained a manually fed sheet detecting operation on the manual feed tray 20*d* shown in FIG. 1, with reference to FIG. 2 which is a schematic magnified view of said manual insert tray 20*d*.

Figure 2:
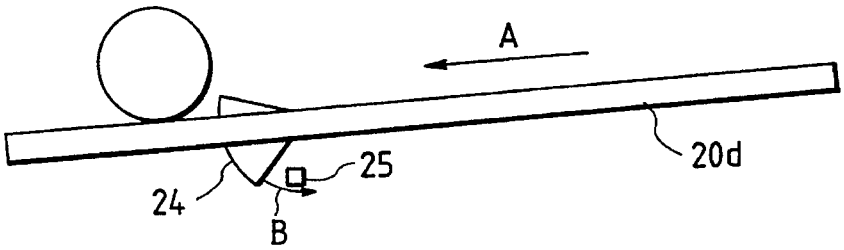
FIG. 2 is a schematic magnified view of a manual insert tray of the color image forming apparatus shown in FIG. 1.

When a recording material is placed along an arrow A on the manual feed tray 20*d* as shown in FIG. 2, a lever 24 moves in a direction B by the weight of the recording material and intercepts a Hall element 25, whereby the manual feed mode is informed to the controller 30. In the manual feed mode of the present embodiment, the operator places one or plural recording materials on the manual feed tray 20*d* and then actuates the copy button, whereby said recording materials are supplied, one at a time, to the transfer drum 9.

In the following, there will be explained the sequence switching control in the image forming apparatus of the present invention, with reference to FIG. 3 which is a flow chart showing an example of the sequence of such control, wherein S1 to S5 indicate process steps.

At first, when the copy button is depressed, the controller 30 discriminates, by the output of the Hall element 25, whether a sheet is set on the manual feed tray 20*d* (S1). If set, it executes a second sequence for activating the oil removing roller 21 after the image transfer, and terminates the sequence after the sheet is discharged from the apparatus.

On the other hand, if the discrimination of the step S1 turns out negative, there is discriminated whether an automatic two-side image forming mode has been set by the operation unit (not shown), and, if set, there is executed a first sequence which does not activate the oil removing roller 21 after the image transfer (S3). Then the second sequence is executed for the inverted sheet, supplied through the intermediate tray 20*c*, and the sequence is terminated after the sheet is discharged from the apparatus.

On the other hand, if the discrimination of the step S2 turns out negative, the first sequence is executed (S4), and the sequence is terminated after the discharge of the sheet from the apparatus.

Consequently the present embodiment can securely prevent the transfer of the oil, coated in the fixing unit 17, to the photosensitive drum 3 through the recording material and the transfer sheet, since the second sequence for activating the oil removing roller 21 after the image transfer is preferentially executed for the manually fed recording material. Also for the recording material fed from the sheet feed cassette 20*a* or 20*b*, the oil removing roller 21 is not activated, after the image transfer, but it is activated only for the recording material fed from the intermediate tray 20*c*, so that extension of the service life can be achieved for said oil removing roller 21 and the transfer sheet coming into sliding contact with said oil removing roller 21.

Also in the apparatus of the present embodiment, there may be provided means for discriminating whether sheet jamming has occurred in the course of image formation, and the operation of the oil removing roller 21 may be controlled according to said discrimination. More specifically, as the apparatus can discriminate, in case of the automatic two-side image formation, whether the recording material has passed the fixing unit 17 and has therefore been subjected to oil deposition, there is executed a control sequence, only in case of sheet jamming in the course of image formation on the second face of the recording material bearing the fixed toner image on the first face, of separating the transfer drum 9 from the photosensitive drum 3, simultaneously rotating said transfer drum 9 and bringing the oil removing roller 21 into contact to clean the transfer sheet, in the course of a restoring operation after the jammed recording material is removed.

In the manual feeding mode, as explained in the foregoing, there may result an erroneous discrimination as to whether the oil has been deposited onto the recording material, because of a setting error of the operator or an erroneous judgment of the sensor. Consequently, in case of sheet jamming in the manual feed mode, the oil removing roller 21 is always activated in the restoring operation after the removal of the jammed recording material.

2nd Embodiment

Figure 4:
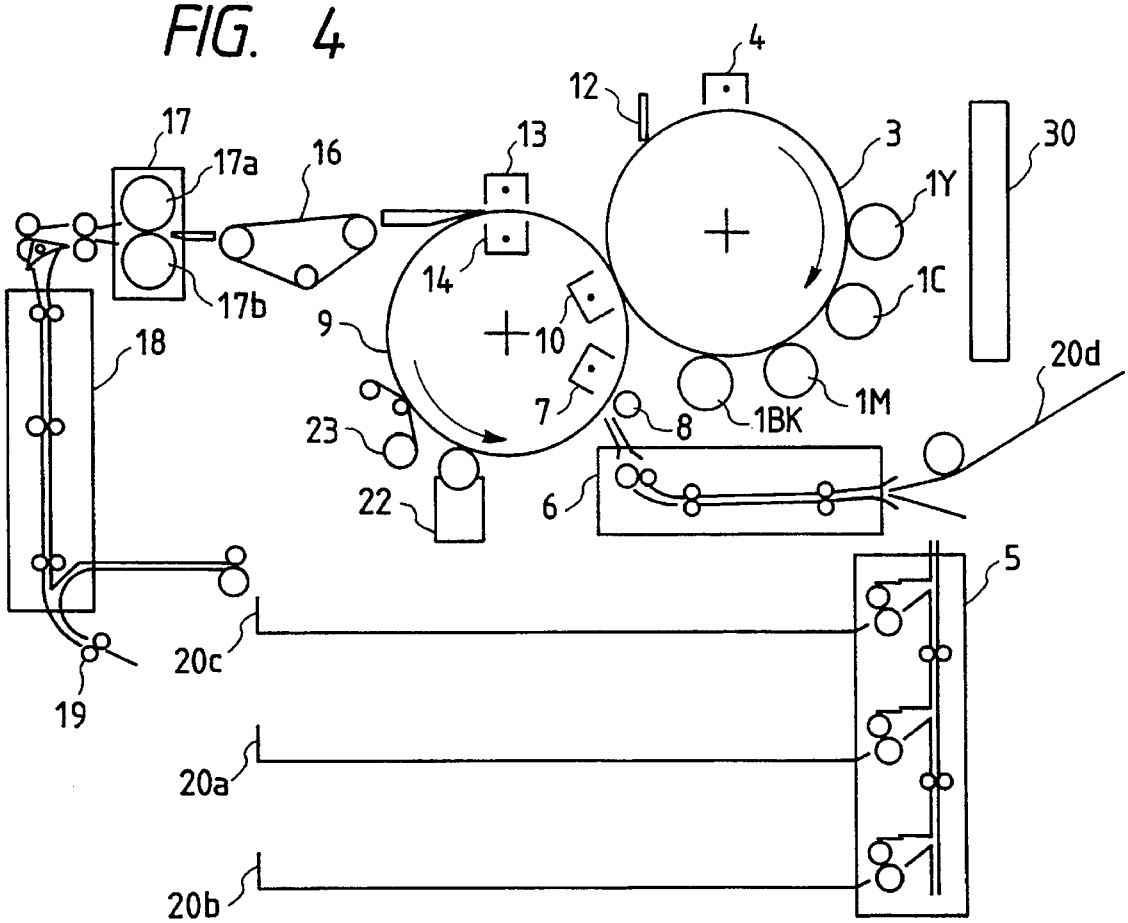
FIG. 4 is a schematic view of a color image forming apparatus constituting a second embodiment of the present invention.

FIG. 4 is a schematic cross-sectional view of an image forming apparatus constituting a second embodiment of the present invention, wherein components same as those in FIG. 1 are represented by same numbers. In the foregoing first embodiment, the oil deposited on the transfer sheet is removed by the oil removing roller 21, but a fur brush cleaner 22 and a cleaning web 23 may be provided as shown in FIG. 4 for removing the oil from the transfer sheet.

In the present embodiment, after the image transfer onto the first face of the recording material supplied from the sheet cassette 20*a* or 20*b* to the transfer drum 9, the transfer drum 9 is separated from the photosensitive drum 3 and effects idle rotation of a full turn, and the fur brush cleaner 22 is rotated in contact with the transfer sheet to achieve cleaning thereof.

Then, also after the image formation on the second face of the recording material of which the first face already bears a toner image fixed by the fixing unit 17, the transfer drum 9 is similarly separated from the photosensitive drum 3 and effects idle rotation of a turn. In this operation, the fur brush cleaner 22 and the cleaning web 23 are brought into contact with the transfer sheet to achieve cleaning thereof.

The fur brush does not damage the transfer sheet but is low in the cleaning efficiency. On the other hand, the cleaning web, being strongly pressed to the transfer sheet, shows a high cleaning efficiency but tends to damage the transfer sheet. Consequently the cleaning is executed with the fur brush cleaner 22 only for the first face where the smear is relatively less because of the absence of the oil deposition, and is executed with both the fur brush cleaner 22 and the cleaning web 23 for the second face showing a higher level of smear. In this manner it is rendered possible to increase the cleaning efficiency and to reduce the damage to the transfer sheet, thereby extending the service life thereof.

Figure 3:
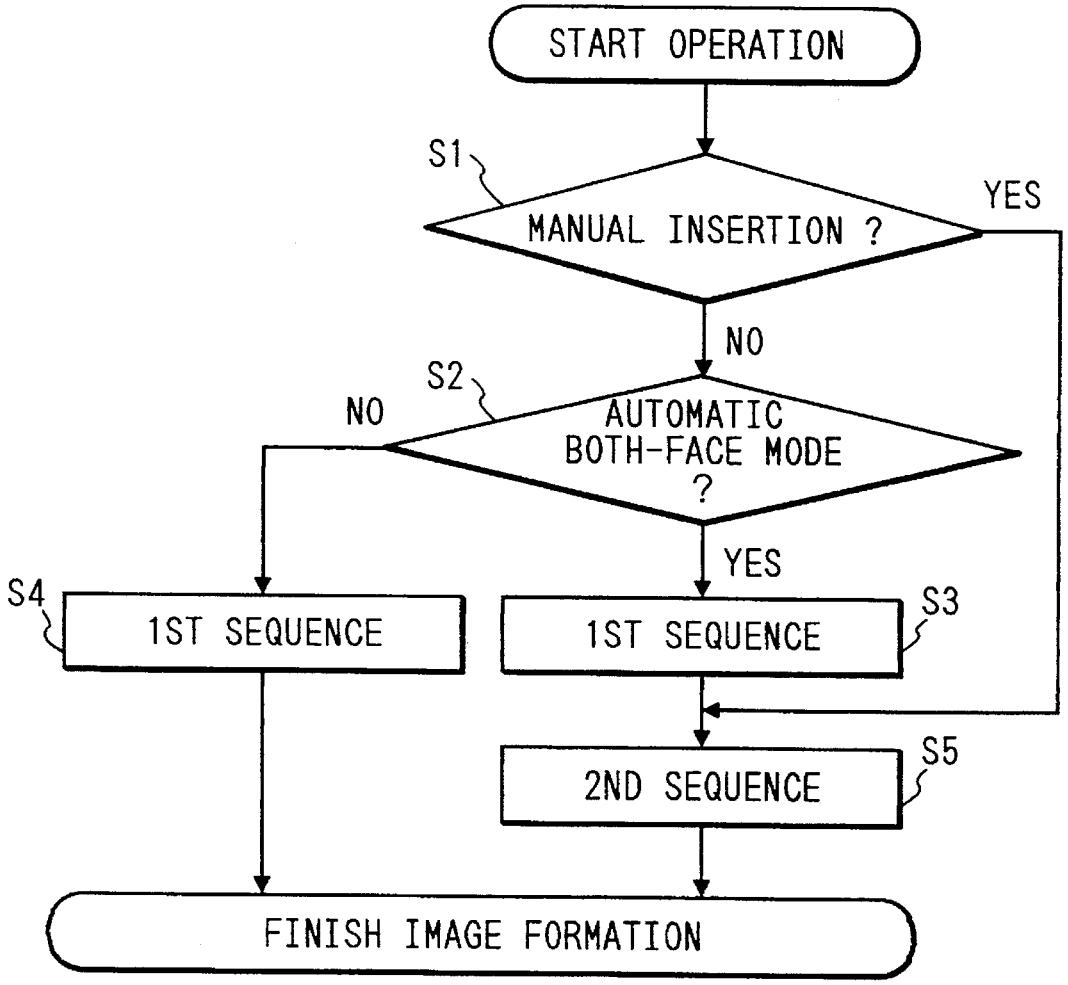
FIG. 3 is a flow chart showing an example of the sequence switching flow in the color image forming apparatus of the present invention.

In case of sheet feeding from the manual feed tray 20*d*, the second sequence is executed as shown in FIG. 3, as it is not possible to discriminate whether the recording material bears oil deposition.

3rd Embodiment

Figure 5:
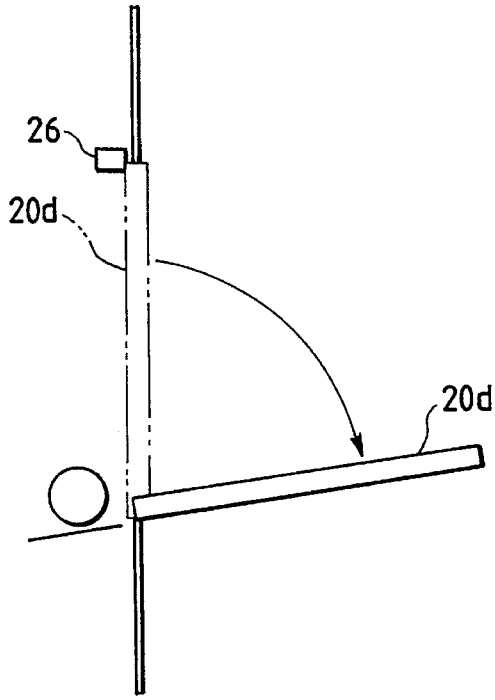
FIG. 5 is a schematic magnified view of a manual feed tray in a third embodiment of the present invention.

In the foregoing 1st and 2nd embodiments, there has been explained the detection of the manually fed sheet while the manual feed tray 20*d* is in a fixed state. However, if the manual feed tray 20*d* is constructed, as shown in FIG. 5, as an openable door of a multiple feeder, it is also possible to discriminate the open-close state of said manual feed tray 20*d* by the state of a switch 26 composed for example of a microswitch, and to cause the controller 30 to recognize the manual feeding mode from the result of said discrimination and to switch the first and second sequences shown in FIG. 3. In the present embodiment, the configuration of the apparatus, other than the manual feed tray 20*d*, is same as that in the 1st and 2nd embodiments.

Also the present embodiment can provide effects similar to those in the 1st and 2nd embodiments.

4th Embodiment

In the foregoing 1st, 2nd and 3rd embodiments, the second sequence shown in FIG. 3 is preferentially executed in response to the detection of presence of the manually fed sheet, but such preferential execution of the second sequence may be conducted in response to the detection of an instruction for the manual feeding mode from a data source.

More specifically, in response to an instruction for the manual feeding mode, supplied from an external data source such as a host computer, the controller 30 preferentially executes the aforementioned second sequence to the manually fed recording material, based on the result of detection by detection means (Hall element 25 shown in FIG. 2). Consequently it is made possible to securely remove the oil deposited in the fixing unit, even if it is not possible to discriminate whether the image formation is to be conducted on the first face or second face of the recording material to be manually fed according to the instruction from the external equipment.

Also in case of a digital image forming apparatus for forming images on both faces of the recording material by receiving printing information for example from a host computer, the manual feeding mode or the automatic two-side image formation mode is set by the operation panel of the image forming apparatus or by the display panel of the host equipment, and the image formation is executed according to the flow shown in FIG. 3. Also in case of a recording material on which the images are to be formed on both faces, such as an envelope, the switching control of the first and second sequences may be conducted according to the selection of the material.

Furthermore, the present invention is applicable to a system consisting of plural equipment, or an apparatus consisting of a single equipment. It is further naturally applicable to a case in which the present invention is achieved by the supply of a program to a system or an apparatus.

What is claimed is:

1. An image forming apparatus comprising:

an image bearing member for bearing an image thereon;

a transfer material support member for supporting a transfer material and bringing said transfer material to said image bearing member, an image of said image bearing member being transferred to the transfer material supported by said transfer material support member to form an unfixed image thereon;

fixing means for fixing the unfixed image formed on said transfer material to said transfer material and being coated with an oil; and oil removing means for removing the oil deposited to said transfer material support member;

wherein said image forming apparatus selects either a first mode in which, after the fixation of the image by said fixing means on a first face of said transfer material, the transfer material bearing the fixed image on the first face is automatically supported on said transfer material support member to transfer an image of said image bearing member to a second face different from said first face of said transfer material, or a second mode in which, after the fixation of the image by said fixing means on a first face of a manually inserted transfer material, said transfer material is discharged from the apparatus without image formation on a second face different from said first face of the transfer material; and in case of selection of said first mode, said oil removing means do not effect the oil removal after the transfer of the image of said image bearing member to the first face of said transfer material but effects the oil removal after the transfer of the image of said image bearing member to the second face of said transfer material, while, in case of selection of said second mode, said oil removing means effects the oil removal after the transfer of the image of said image bearing member to the transfer material regardless whether the manually inserted transfer material has passed said fixing means.

2. An image forming apparatus according to claim 1, wherein said oil removing means is a web.

3. An image forming apparatus according to claim 1, further comprising cleaning means for cleaning said transfer material support member after the image of said image bearing member is transferred to the transfer material supported by said transfer material support member.

4. An image forming apparatus according to claim 3, wherein said cleaning means is a fur brush.

5. An image forming apparatus according to claim 1, further comprising detection means for detecting the presence of a transfer material in a manual sheet feeding unit, and control means for controlling the operation of said oil removing means based on the detected result by said detection means.

6. An image forming apparatus according to claim 1, further comprising a sheet feeding tray provided openably in a manual sheet feeding unit, detection means for detecting the open-close state of said sheet feeding tray, and control means for controlling the operation of said oil removing means based on the detected result by said detection means.

7. An image forming apparatus according to claim 1, wherein said fixing means includes a pair of rollers for pinching the transfer material, and oil is coated on a roller coming into contact with the unfixed image formed on said transfer material.

8. An image forming apparatus according to claim 1, wherein said oil removing means has a roller shape.

9. An image forming apparatus according to claim 1, wherein toner images of plural colors supported in succession by said image bearing member are transferred sequentially and in superposed manner to the transfer material supported by said transfer material support member, for forming a full color image.

10. An image forming apparatus comprising:

an image bearing member for bearing an image thereon;

a transfer material support member for supporting a transfer material and bringing said transfer material to said image bearing member, an image of said image bearing member being transferred to the transfer material supported by said transfer material support member to form an unfixed image thereon;

fixing means for fixing the unfixed image, formed on said transfer material, to said transfer material and being coated an oil; and oil removing means for removing the oil deposited to said transfer material support member;

wherein said image forming apparatus selects either a first mode in which, after the fixation of the image by said fixing means on a first face of said transfer material fed from a sheet feeding cassette, said transfer material is discharged from the apparatus without image formation on a second face different from said first face of said transfer material, or a second mode in which, after the fixation of the image by said fixing means on a first face of the manually fed transfer material, said transfer material is discharged from the apparatus without image formation on a second face different from said first face of said transfer material; and in case of selection of said first mode, said oil removing means do not effect the oil removal after the transfer of the image of said image bearing member to the transfer material, while, in case of selection of said second mode, said oil removing means effects the oil removal after the transfer of the image of said image bearing member to the transfer material regardless whether the manually fed transfer material has passed said fixing means.

11. An image forming apparatus according to claim 10, wherein toner images of plural colors supported in succession by said image bearing member are transferred sequentially and in superposed manner to the transfer material supported by said transfer material support member, for forming a full color image.

12. An image forming apparatus according to claim 2, further comprising cleaning means for cleaning said transfer material support member after the image of said image bearing member is transferred to the transfer material supported by said transfer material support member.

13. An image forming apparatus according to claim 12, wherein said cleaning means is a fur brush.

* * * * *

UNITED STATES PATENT AND TRADEMARK OFFICE

CERTIFICATE OF CORRECTION

PATENT NO. : 5,523,830

DATED : June 4, 1996

INVENTOR(S) : SATOSHI TAMURA, ET AL.

It is certified that error appears in the above-indentified patent and that said Letters Patent is hereby corrected as shown below:

COLUMN 2

Line 26, "formed" should read --is formed--.

COLUMN 3

Line 66, "effects" should read --effect--.

COLUMN 7

Line 33, "do" should read --does--;
Line 41, "whether" should read --of whether--; and
Line 61, "open-close" should read --open-closed--.

COLUMN 8

Line 24, "an" should read --with an--;
Line 41, "do" should read --does--; and
Line 46, "whether" should read --of whether--.

Signed and Sealed this

Twenty-fifth Day of March, 1997

*Attest:*

Bruce Lehman

BRUCE LEHMAN

*Attesting Officer*

*Commissioner of Patents and Trademarks*